US006669353B2

(12) United States Patent
Kung

(10) Patent No.: US 6,669,353 B2
(45) Date of Patent: Dec. 30, 2003

(54) FLASHLIGHT

(75) Inventor: Kenneth Kung, Tai Tam (HK)

(73) Assignee: Tung Fat Industries Ltd., Kowloon (HK)

( * ) Notice: Subject to any disclaimer, the term of this patent is extended or adjusted under 35 U.S.C. 154(b) by 0 days.

(21) Appl. No.: 09/973,289

(22) Filed: Oct. 5, 2001

(65) Prior Publication Data

US 2003/0067771 A1 Apr. 10, 2003

(51) Int. Cl.[7] ..... F21V 21/00
(52) U.S. Cl. ..... 362/191; 362/398; 362/208
(58) Field of Search ..... 362/190, 191, 362/208, 382, 398, 396, 418, 285, 421

(56) References Cited

U.S. PATENT DOCUMENTS

| | | | | |
|---|---|---|---|---|
| 3,418,461 A | | 12/1968 | Sedlock | 240/52.5 |
| 3,612,853 A | * | 10/1971 | Sakaki | 362/191 |
| 4,208,703 A | * | 6/1980 | Orr | 362/190 |
| 4,399,498 A | | 8/1983 | Bacevius | 362/396 |
| 4,897,768 A | | 1/1990 | Thul | 362/191 |
| 5,213,412 A | | 5/1993 | Ciallella | 362/398 |
| 5,303,133 A | * | 4/1994 | Wagner | 362/191 |
| 5,400,234 A | | 3/1995 | Yu | 362/386 |
| 5,573,329 A | | 11/1996 | van Gennep | 362/191 |
| 5,873,651 A | * | 2/1999 | Hofer et al. | 362/398 |
| 6,062,703 A | | 5/2000 | Tsao | 362/184 |

FOREIGN PATENT DOCUMENTS

| | | |
|---|---|---|
| DE | 94 13 425 U | 10/1994 |
| FR | 2 786 540 A | 6/2000 |

* cited by examiner

*Primary Examiner*—Y. My Quach-Lee
(74) *Attorney, Agent, or Firm*—Ladas & Parry

(57) ABSTRACT

A flashlight and support assembly for supporting the position of a flashlight in a variety of different positions. The support assembly is interchangeable and may comprise a tripod, a belt clip, and/or a magnetic block. The user has the ability to alternate between the use of a tripod, magnetic block, or belt clip. By using these attachments, it is possible to sustain the position of a flashlight over long periods of time without having to readjust the flashlight and the flashlight can be held in many different positions in order to shine light where needed by the user thereof.

21 Claims, 5 Drawing Sheets

FLASHLIGHT

FIELD OF THE INVENTION

The present invention relates to a flashlight and associated apparatuses for supporting it. The present invention also relates to a flashlight support assembly for securing, stabilizing, and removing a flashlight from a device which can support the flashlight in a variety of directions and positions.

BACKGROUND OF THE INVENTION

This invention relates to a "third hand" for a flashlight or the like, particularly for adjustably holding the flashlight in a selected one of a plurality of positions and orientations, relieving the hands of the user.

Mechanics, installers, repairpersons and the like commonly have the need to apply portable lighting to their work and, particularly, to aim a beam of light, such as from a flashlight, on a particular portion of the work while the hands remain free to perform operations on the work or to hold tools. It is therefore often desired to adjustably and temporarily fix the flashlight or other light source in space at a particular location and orientation. However, the light must be attached to or rest upon something if it is not held by the worker's hand, and it is not generally the case that the work or site has a specialized provision for this purpose.

A common, but convenient, solution to this problem is for the worker to hold the butt of the flashlight in his or her mouth. A variation of this concept is exemplified by Sedlock, U.S. Pat. No. 3,418,461, wherein a bracket is provided on the flashlight having a mouthpiece for clenching between the user's teeth.

Bacevius, U.S. Pat. No. 4,399,498, provides a clamp housing, one end of which is adapted to receive a flashlight or lantern and the other end of which defines a clamping jaw, and a complementary movable jaw biased with a spring means. The span opening or distance between the gripping jaws can be adjusted for clamping onto surfaces having variable cross sectional shapes. While it is asserted that a wide range of jaw opening is provided, the range of suitable supports remains limited. Moreover, angular adjustment of the direction of the light is also limited in range as well as being limited to one axis.

Thul, U.S. Pat. No. 4,897,768, provides an arcuate track that is mountable with suction cups to a supporting surface. A flashlight is strapped to the track at a selected location and, therefore, inclination. A drawback of the device is that varying the inclination requires two hands for manipulating the strap. Another drawback is that, without removing the suction cups from the support surface, the inclination is adjustable only about one axis. Yet another drawback is that a support surface sufficiently flat and large to receive widely spaced-apart suction cups is required. Van Gennep, U.S. Pat No. 5,573,329, provides a clamping pliers carrying a ball and socket joint for a flashlight holder. A disadvantage of clamping pliers is that they are generally limited to clamping onto objects that can be gripped with a relatively small jaw opening and may cause damage to some of objects, particularly if misadjusted.

Accordingly, there is a need for a flashlight support assembly that provides for attachment to, or stabilization upon, a wide variety and range of support objects and surfaces, and provides a wide range of positional and directional adjustability obtained with a minimum of repositioning.

SUMMARY OF THE INVENTION

The present invention solves the aforementioned problems and meets the aforementioned needs by providing a flashlight and support assembly which can support the position of the flashlight in a number of environments.

The present invention solves the aforementioned problems by providing a set of interchangeable attachments which can be conveniently coupled to a flashlight to support a variety of flashlight positions in a hands free environment. The flashlight and support assembly includes, a support member coupled to an attachment, and a receiving slot. The support member and the receiving slot have mutually engaging devices to serve as a locking mechanism. When the support member is disposed of inside the receiving slot, the mutually engaging devices engage, to prevent the support member from unintentionally sliding out of the receiving slot. The flashlight and support assembly also allow the attachments to be easily detached from the flashlight when the attachments are not needed.

The interchangeable attachments for the flashlight are used in conjunction with a variety of applications. One attachment used is a tripod. The tripod can be used to aim the flashlight in a desired direction for an extended period of time without having to readjust the position of the flashlight. The tripod gives the flashlight the ability to have pitch movements so that the direction of the light beam can be adjusted. Additionally, the legs of the tripod can be folded so as to minimize the size of the tripod, when space is a limitation.

The magnetic block is another interchangeable attachment which is used. The magnetic block, like the tripod, can be used to aim the flashlight in a desired direction for an extended period of time without having to readjust the position of the flashlight. However, unlike the tripod, the magnetic block allows use of the flashlight without having to support the flashlight on the ground. The magnetic block allows the flashlight for example, to be attached to a magnetic object in free space, or attached to a magnetic object on a wall.

The belt clip is another interchangeable attachment used in conjunction with the flashlight. The belt clip can be used to attach the flashlight to an object, which can at least partially fit between the belt clip. As a result the belt clip can be used to support the flashlight by attaching it to objects in free space, or objects that are on the ground.

All of the interchangeable attachments aforementioned can easily be changed when a flashlight is being used. By allowing an operator to quickly and easily change attachments, the operator can quickly adapt to changes in the environment in which the flashlight is being used.

The foregoing and other objects, features and advantages of the invention will be more readily understood upon consideration of the following detailed description of the invention, taken in conjunction with the following drawings. Also, the attachments do not need to be used in conjunction with specialized equipment. They are all adaptable to common situations that are encountered when using a flashlight.

DETAILED DESCRIPTION OF PREFERRED EMBODIMENTS

The present invention will now be described more fully hereinafter with reference to the accompanying drawings, in which preferred embodiments of the invention are shown. This invention may be embodied in many different forms and should not be construed as limited to the embodiments set forth herein.

A flashlight and support assembly for supporting the flashlight using interchangeable attachments is described with reference to FIGS. 1–6. Shown in these figures is a flashlight and support assembly that consists of a flashlight, a receiving slot, a support member, and several interchangeable attachments connected to the support member. The support member preferably contains a protruberance. When the support member is disposed inside the receiving slot, the protruberance prevents the support member from unintentionally sliding out of the receiving slot. However, when an operator wants to remove the interchangeable attachment from the flashlight, the attachment can easily be disengaged from the flashlight.

Figure 1:
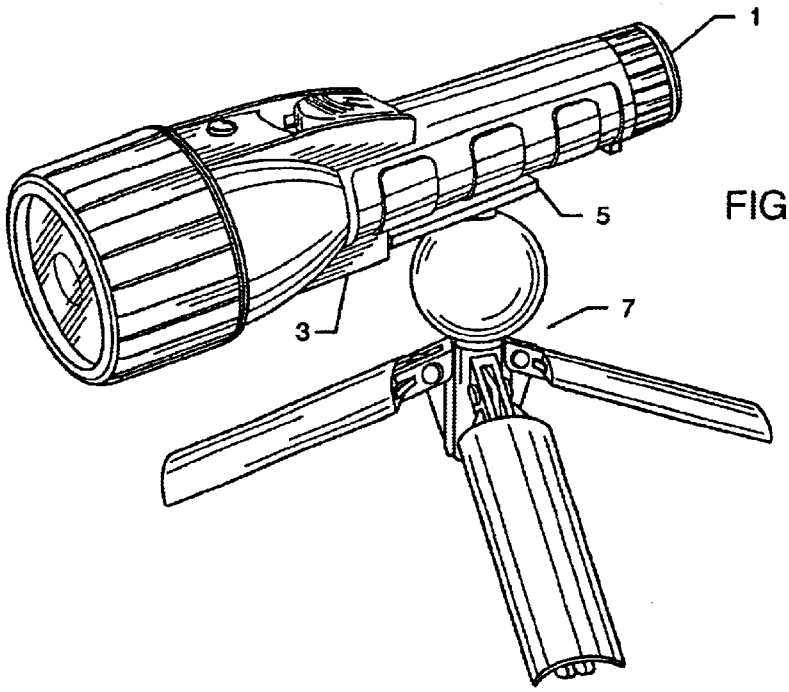
FIG. 1 is a perspective view of the flashlight according to a first embodiment.
Figure 2:
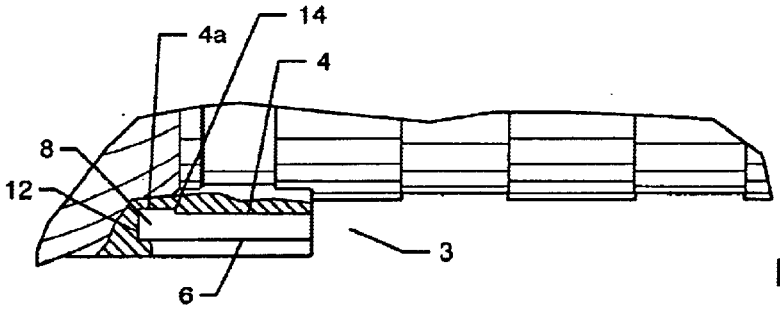
FIG. 2 is a cross sectional view of the receiving slot.
Figure 3:
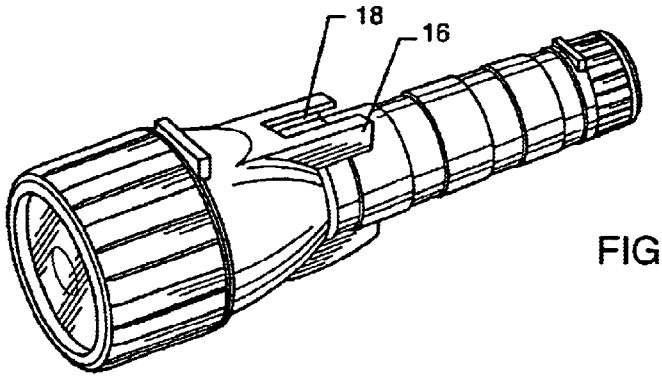
FIG. 3 is a perspective view of the receiving slot.

The flashlight and support assembly according to a first embodiment will now be described with reference to FIGS. 1–5. FIG. 1 shows the flashlight and support assembly according to the first embodiment of this invention. The flashlight and support assembly for a flashlight 1 includes a receiving slot 3 located on the flashlight 1 and a support member 5 attached to a tripod attachment 7, the support member 5 engaging with the receiving slot when the flashlight is supported. The receiving slot 3, shown in FIG. 2 includes a first surface 4, and a parallel second surface 6 opposing, but spaced equally from the first surface 4. A portion of the first surface 4 preferably has an indentation formed in it so as to define a detent 8. The detent 8 is comprised of a first surface 4*a*, a first wall 12, extending between the first surface 4*a* and the second surface 6, and a second wall 14, extending between the first surface 4*a*, and the first surface 4. FIG. 3 is a perspective view of the receiving slot 3, which shows the first and second sidewalls 16, 18.

Figure 4A:
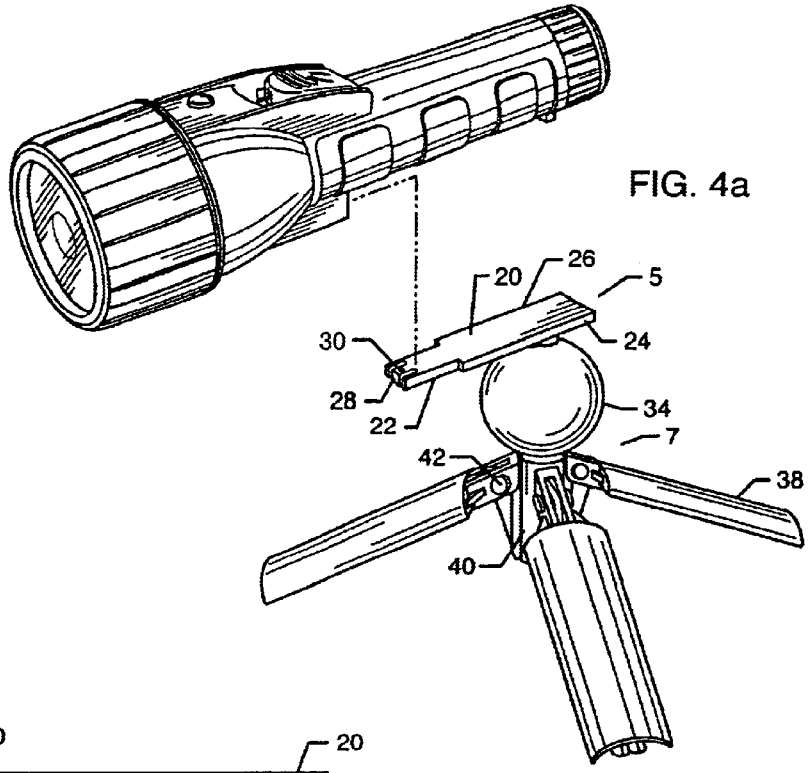
FIG. 4*a* is a perspective view of the support member according to one aspect of this invention.
Figure 4B:
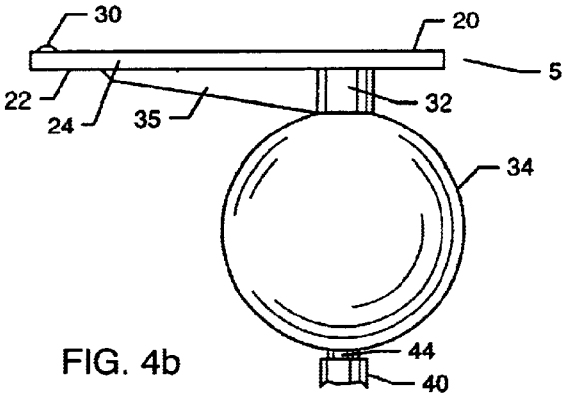
FIG. 4*b* is a cross sectional view of the tripod.

Referring to FIGS. 4*a*–4*b*, the tripod 7 comprises a sphere 34, the aforementioned support member 5, and a plurality of legs 38. The support member 5 preferably comprises a first surface 20, a second surface 22, first and second sidewalls 24, 26, a front face 28, and a protruberance 30. The support member 5 is preferably attached to the sphere 34 with a rigid joint 32. The support member 5 also includes a support beam 35 mounted longitudinally on the bottom surface 22 of the support member 5 and connected to the rigid joint 32 to help support the weight of flashlight 1.

Figure 4C:
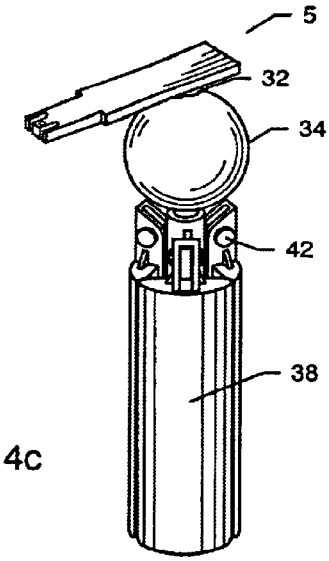
FIG. 4*c* is a perspective of the tripod according to an alternate embodiment.
Figure 4D:
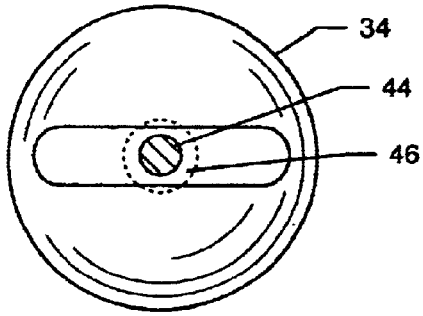
FIG. 4*d* is a bottom view of the sphere of the tripod.
Figure 4E:
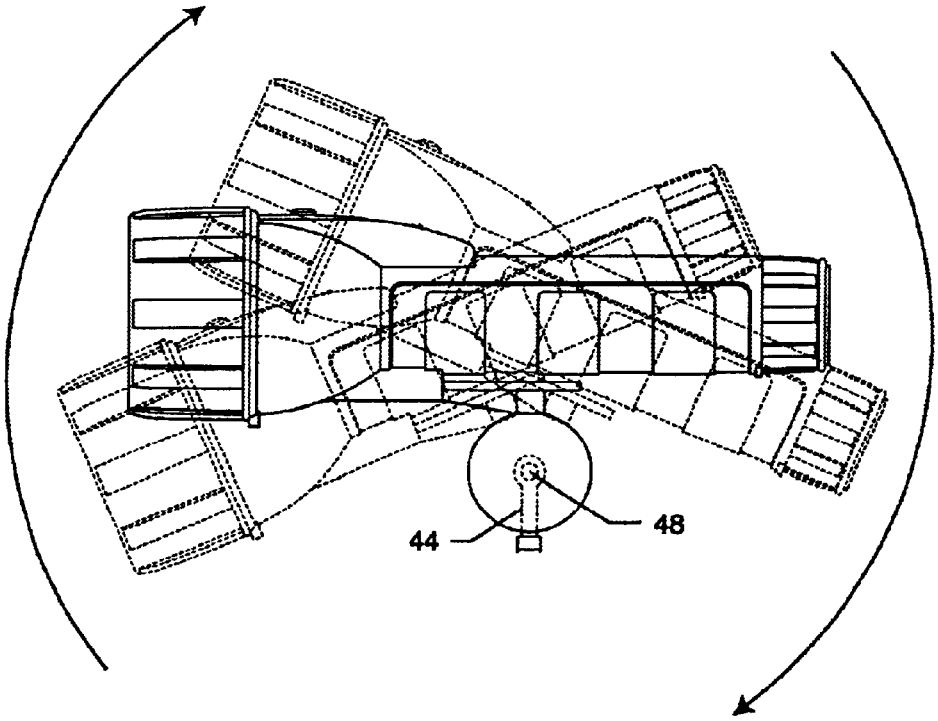
FIG. 4*e* is a cross sectional view of the sphere and the flashlight.

The plurality of legs 38 are mounted to a central column 40 via hinges 42, which allow the plurality of legs 38 to project outwards, as well as retract, forming a circular surface as seen in FIG. 4*c*. When the plurality of legs 38 project outwards, they are preferably spaced apart equally. An arm 44 is used to attach the central column 40 to sphere 34. As shown in FIGS. 4*d*–4*e*, the sphere 34 contains a cavity 46, wherein the arm 44 is engaged about a pin 48. The arm 44 engaged in the sphere 34 about the pin 48 allows the sphere 34 to have pitch movement about the engaged arm 44 as shown in FIG. 4*e* due to the presence of cavity 46 in sphere 34 (See FIG. 4*d*).

Figure 5:
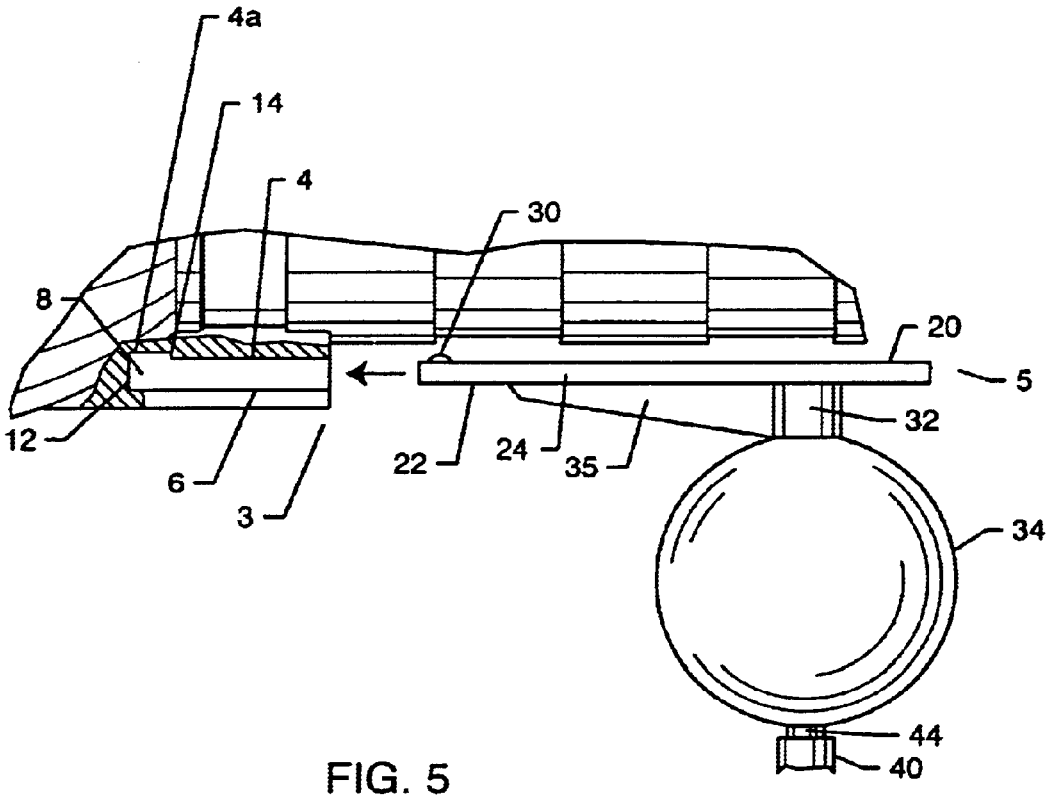
FIG. 5 is a cross sectional view of the support member being inserted in the receiving slot.
Figure 6C:
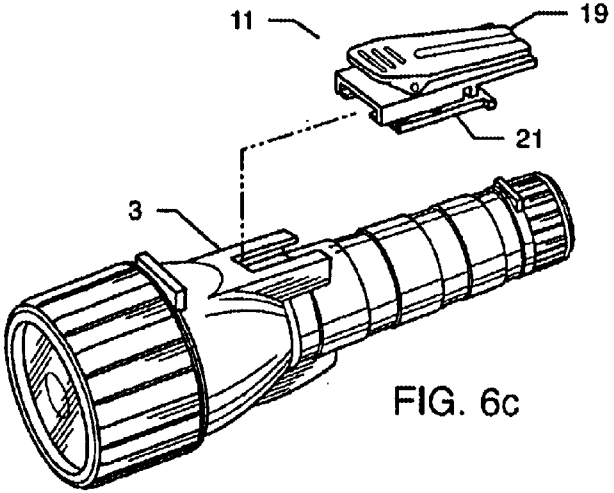
FIG. 6*c* is a perspective view of the flashlight according to an alternate embodiment of this invention.
Figure 6D:
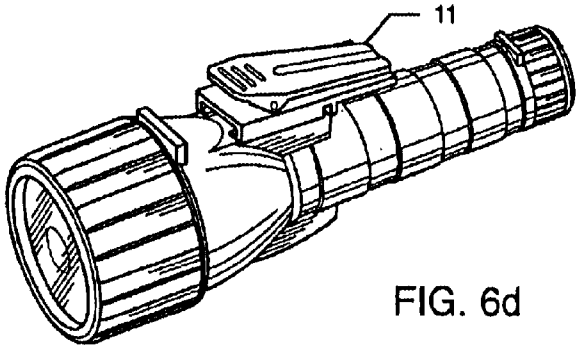
FIG. 6*d* is a perspective view of the flashlight according to an alternate embodiment of this invention.
Figure 6A:
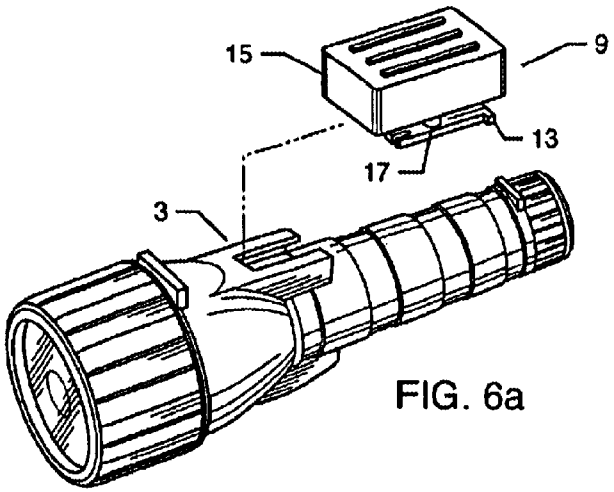
FIG. 6*a* is a perspective view of the flashlight according to an alternate embodiment of this invention.
Figure 6B:
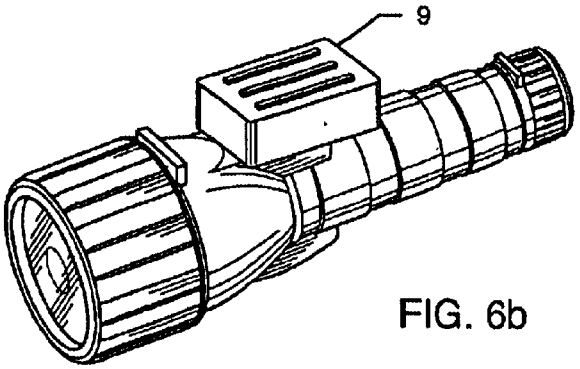
FIG. 6*b* is a perspective view of the flashlight according to an alternate embodiment of this invention.

The support member 5 may be detachably disposed in the receiving slot as shown in FIG. 5. When the support member 5 is disposed inside the receiving slot 3, the first surface 20 of the support member 5 contacts the first surface 4 of the receiving slot 3. The second surface 22 of the support member 5 contacts the second surface 6 of the receiving slot 3, and the first and second sidewalls 24, 26 of the support member 5 contact the first and second sidewalls 16,18 of the receiving slot 3. Also, the protruberance 30 is disposed inside the detent 8 to prevent the unintentional release of the support member 5 from the receiving slot 3.

According to another embodiment, a magnetic block attachment 9 or belt clip attachment 11 is used, as shown in FIGS. 6*a*–6*d*. The magnetic block attachment 9 consists of a support member 13 and a magnetic block 15. The magnetic block 15 and the support member 13 are attached with a rigid joint 17. Similarly, the belt clip attachment 11 consists of a belt clip 19 mounted to a support member 21. The support member 13 of the magnetic block and the support member 21 of the belt clip are both disposed inside the receiving slot 5 on the flashlight 1. The flashlight 1 can be conveniently packaged with a tripod attachment 7, a magnetic block attachment 9, and/or a belt clip 11. The flashlight 1 can be supported by any one of the attachments 7, 9, 11 or it may be handheld in a convenient position.

Let it be understood that the foregoing description is only illustrative of the invention. Various alternatives and modifications can be devised by those skilled in the art without departing from the spirit of the invention. Accordingly, the present invention is intended to embrace all such alternatives, modifications, and variances which fall within the scope of the appended claims.

What is claimed is:

1. A flashlight and support assembly comprising:

a flashlight having a receiving slot, the receiving slot having a first surface, a second surface, first and second sidewalls;

a set of interchangeable flashlight attachments, each flashlight attachment having a support member, wherein the support member comprises a first and second surface, first and second sidewalls, the support members being adopted to be temporarily disposed in the receiving slot of the flashlight for supporting the flashlight in a variety of positions; and mutually engaging devices associated with the support member and the receiving slot for temporarily locking the support member in the receiving slot.

2. The flashlight and support assembly of claim 1, wherein the mutually engaging devices comprise a protruberance located on the support member and a detent located in the receiving slot to prevent the support member from unintentionally sliding out of the receiving slot.

3. The flashlight and support assembly of claim 2, wherein the detent is comprised of a first surface, a first wall, and a second wall.

4. The flashlight and support assembly of claim 1, wherein the first and second sidewalls of the receiving slot prevent the support member from moving in a direction perpendicular to the first and second sidewalls of the receiving slot.

5. The flashlight and support assembly of claim 1, wherein the set of interchangeable attachments consist of a tripod, magnetic block, and belt clip.

6. The flashlight and support assembly of claim 5, wherein the tripod allows the flashlight to have pitch movement.

7. The flashlight and support assembly of claim 5, wherein the tripod includes a plurality of legs which can be retracted.

8. The flashlight and support assembly of claim 7, wherein the plurality of legs of the tripod when retracted define an outwardly facing circular surface.

9. The flashlight and support assembly of claim 5, wherein the magnetic block allows the flashlight to be attached to a magnetic object.

10. The flashlight and support assembly of claim 5, wherein the belt clip allows the flashlight to be attached to an object, wherein at least a portion of the object fits between the belt clip.

11. The flashlight and support assembly of claim 1, wherein the set of interchangeable attachments independently support the flashlight in a variety of positions.

12. A method of supporting a flashlight comprising the steps of:

attaching interchangeable attachments to the flashlight by;

disposing a support member attached to the interchangeable attachments in a receiving slot located on the flashlight; and engaging mutually engaging devices of the support member and the receiving slot to prevent the unintentional release of the support member from the receiving slot, wherein the mutually engaging devices include a protruberance located on the support member and a detent located in the receiving slot;

positioning the flashlight using the interchangeable attachments.

13. The method of claim 12, wherein the interchangeable attachments consist of a tripod, magnetic block, and belt clip.

14. The method of claim 13, wherein the tripod allows the flashlight to have pitch movement.

15. The method of claim 13, wherein the tripod includes a plurality of legs which can be retracted.

16. A method of claim 15, wherein the plurality of legs of the tripod when retracted define an outwardly facing circular surface.

17. The method of claim 13, wherein the magnetic block allows the flashlight to be attached to a magnetic object.

18. The method of claim 13, wherein the belt clip allows the flashlight to be attached to an object, wherein at least a portion of the object fits between the belt clip.

19. The method of claim 12, wherein the interchangeable attachments independently support the flashlight.

20. A flashlight and support assembly wherein the flashlight has a receiving slot for detachably receiving a support member associated with the support assembly; and the support assembly comprises a multiple-legged support stand coupled to the support member, the flashlight and support assembly further comprising mutually engaging devices for temporarily locking the support member in the receiving slot.

21. The flashlight and support assembly of claim 20, wherein the support assembly includes a ball joint for coupling the multi-legged support stand to the support member.

* * * * *